US009879202B2

(12) United States Patent
Bera et al.

(10) Patent No.: US 9,879,202 B2
(45) Date of Patent: Jan. 30, 2018

(54) MARINE ENGINE LUBRICATION

(71) Applicant: Infineum International Limited, Abingdon (GB)

(72) Inventors: Tushar K. Bera, Fulshear, TX (US); Laura Gregory, Marlborough (GB); Rachel Tundel, Brooklyn, NY (US); Peter M. Wright, Mountainside, NJ (US)

(73) Assignee: INFINEUM INTERNATIONAL LIMITED (GB)

( * ) Notice: Subject to any disclaimer, the term of this patent is extended or adjusted under 35 U.S.C. 154(b) by 88 days.

(21) Appl. No.: 14/560,231

(22) Filed: Dec. 4, 2014

(65) Prior Publication Data

US 2016/0160149 A1 Jun. 9, 2016

(51) Int. Cl.

*C10M 161/00* (2006.01)
*C10M 105/08* (2006.01)
*C10M 105/22* (2006.01)

(52) U.S. Cl.

CPC .. *C10M 161/00* (2013.01); *C10M 2203/1025* (2013.01); *C10M 2205/0285* (2013.01); *C10M 2207/129* (2013.01); *C10M 2207/262* (2013.01); *C10M 2223/045* (2013.01); *C10N 2210/02* (2013.01); *C10N 2220/021* (2013.01); *C10N 2230/04* (2013.01); *C10N 2230/52* (2013.01); *C10N 2230/54* (2013.01); *C10N 2240/102* (2013.01); *C10N 2270/02* (2013.01)

(58) Field of Classification Search

CPC ..... F01P 11/08; F01P 2060/04; F01P 3/20; F01P 7/165; F01M 5/002; C10M 161/00; C10M 2203/1025; C10M 2205/0285; C10M 2207/129; C10M 2207/262; C10M 2223/045; C10N 2210/02; C10N 2220/021; C10N 2230/04; C10N 2230/52; C10N 2230/54; C10N 2240/102; C10N 2270/02

USPC ..... 123/41.33

See application file for complete search history.

(56) References Cited

U.S. PATENT DOCUMENTS

| | | | | |
|---|---|---|---|---|
| 3,087,936 | A | 4/1963 | Le Suer | |
| 3,172,892 | A | 3/1965 | Le Suer et al. | |
| 3,215,707 | A | 11/1965 | Rense | |
| 3,219,666 | A | 11/1965 | Norman et al. | |
| 3,231,587 | A | 1/1966 | Rense | |
| 3,272,746 | A | 9/1966 | Le Suer et al. | |
| 3,275,554 | A | 9/1966 | Wagenaar | |
| 3,381,022 | A | 4/1968 | Le Suer | |
| 3,442,808 | A | 5/1969 | Traise | |
| 3,565,804 | A | 2/1971 | Honnen et al. | |
| 3,912,764 | A | 10/1975 | Palmer, Jr. | |
| 4,110,349 | A | 8/1978 | Cohen | |
| 4,152,499 | A | 5/1979 | Boerzel et al. | |
| 4,234,435 | A | 11/1980 | Meinhardt et al. | |
| 5,334,321 | A | 8/1994 | Harrison et al. | |
| 5,489,809 | A | 2/1996 | Kaya et al. | |
| 5,663,130 | A | 9/1997 | Emert et al. | |
| 5,705,577 | A | 1/1998 | Rossi et al. | |
| 5,777,025 | A | 7/1998 | Spencer et al. | |
| 5,814,715 | A | 9/1998 | Chen et al. | |
| 5,891,953 | A | 4/1999 | Spencer et al. | |
| 6,022,929 | A | 2/2000 | Chen et al. | |
| 6,030,930 | A | 2/2000 | Emert et al. | |
| 6,127,321 | A | 10/2000 | Emert et al. | |
| 8,012,918 | B2 * | 9/2011 | Bertram | C10M 129/54 508/460 |
| 2004/0121918 | A1 * | 6/2004 | Rea | C10M 167/00 508/291 |
| 2007/0027057 | A1 | 2/2007 | Le Coent et al. | |
| 2012/0028521 | A1 * | 2/2012 | Garner | C10M 169/045 440/88 L |
| 2013/0281334 | A1 * | 10/2013 | Dodd | C10M 129/26 508/306 |

FOREIGN PATENT DOCUMENTS

| | | | |
|---|---|---|---|
| CA | 1335895 | C | 6/1995 |
| CA | 2471534 | C | 9/2009 |
| EP | 0382450 | B1 | 6/1995 |
| EP | 2644687 | A1 | 10/2013 |
| GB | 1440219 | | 6/1976 |
| WO | WO-2010/115594 | A1 | 10/2010 |
| WO | WO-2010/115595 | A1 | 10/2010 |

OTHER PUBLICATIONS

The American Petroleum Institute, "Engine Oil Licensing and Certification System", Industry Services Dept., 14th Edition, Dec. 1996, Addendum 1, Dec. 1998.

* cited by examiner

*Primary Examiner* — Cephia D Toomer

(57) ABSTRACT

A trunk piston marine engine lubricant comprises in respective minor amounts (A) an overbased metal hydrocarbyl-substituted hydroxybenzoate detergent system, and (B) a hydrocarbyl-substituted succinic acid anhydride, preferably made by halogen- or radical-assisted fractionalization processes, where the ratio of succinic anhydride to hydrocarbyl chains is in the range of 1.4 to 4. The lubricant, when used to lubricate such an engine fuelled by heavy fuel oil, exhibits improved control of asphaltene precipitation and deposition on engine surfaces.

21 Claims, No Drawings

MARINE ENGINE LUBRICATION

FIELD OF THE INVENTION

This invention relates to trunk piston marine engine lubrication for a medium-speed four-stroke compression-ignited (diesel) marine engine.

BACKGROUND OF THE INVENTION

Marine trunk piston engines generally use Heavy Fuel Oil ('HFO') for offshore running. Heavy Fuel Oil is the heaviest fraction of petroleum distillate and comprises a complex mixture of molecules including up to 15% of asphaltenes, defined as the fraction of petroleum distillate that is insoluble in an excess of aliphatic hydrocarbon (e.g. heptane) but which is soluble in aromatic solvents (e.g. toluene) as measured by ASTM D6560. Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer which can result in the formation of cracks that then propagate through the piston. If a crack travels through the piston, hot combustion gases can enter the crankcase, possibly resulting in a crankcase explosion.

It is therefore highly desirable that trunk piston engine oils ('TPEO's) prevent or inhibit asphaltene precipitation, a problem which becomes more acute when the oil of lubricating viscosity has a higher saturates content. The prior art describes ways of doing this by use of metal carboxylate detergents in combination with a polyalkenyl-substituted carboxylic acid anhydride. WO 2010/115594 ('594) and WO 2010/115595 ('595) describe use, in trunk piston marine engine (TPEO) lubricating oil compositions that contain 50 mass % or more of a Group II basestock, of respective minor amounts of a calcium salicylate detergent and of a polyalkenyl-substituted carboxylic acid anhydride. The data therein shows that the combination gives rise to improved asphaltene dispersency. EP-A-2644687 ('687) describes use of a combination of defined calcium salicylates and defined polyalkenyl-substituted carboxylic acid anhydrides in a TPEO lubricant comprising a major amount of an oil of lubricating viscosity containing 50 mass % or more of a Group I basestock. This achieves good asphaltene dispersency at lower and hence more economical levels of soap.

The art does not, however, concern itself with the influence of the succination ratio of the anhydride in such combinations on the problem of asphaltene precipitation such as at higher saturate levels in the oil of lubricating viscosity in a TPEO. Component (B) in the examples of '594 is stated to be a PIBSA derived from a polyisobutene of number average molecular weight 950; its succination ratio is not stated.

SUMMARY OF THE INVENTION

It is now surprisingly found that, when a polyalkenyl carboxylic acid anhydride additive of defined succination ratio, preferably made by a specific process, is used in a TPEO that includes a hydroxybenzoate detergent additive, improved control of asphaltene precipitation and deposition on engine surfaces is achieved, particularly when the oil of lubricating viscosity in the TPEO is a high saturates content oil. The anhydride additive boosts the performance of the detergent additive.

Thus, a first aspect of the invention is a trunk piston marine engine lubricating oil composition for improving asphaltene handling in use thereof, in operation of such engine when fuelled by a heavy fuel oil, which composition comprises, or is made by admixing, an oil of lubricating viscosity and, in respective minor amounts:

(A) an overbased metal hydrocarbyl-substituted hydroxybenzoate detergent system, and (B) a hydrocarbyl-substituted succinic acid anhydride, preferably made using halogen- or radical-assisted functionalization processes, where the ratio of succinic anhydride groups per substituted hydrocarbyl moiety is in the range of 1.4 to 4.

A second aspect of the invention is a method of preparing a trunk piston marine engine lubricating oil composition for a medium-speed compression-ignited marine engine comprising blending (A) and (B) with the oil of lubricating viscosity, each defined as in the first aspect of the invention.

A third aspect of the invention is a trunk piston marine engine lubricating oil composition for a medium-speed four-stroke compression-ignited marine engine obtainable by the method of the second aspect of the invention.

A fourth aspect of the invention is a method of operating a trunk piston medium-speed compression-ignited marine engine comprising:

(i) fuelling the engine with a heavy fuel oil; and (ii) lubricating the engine with a composition as defined in the first aspect of the invention.

A fifth aspect of the invention is a method of dispersing asphaltenes in trunk piston marine lubricating oil composition during its lubrication of surfaces of a medium-speed compression-ignited marine engine and operation of the engine, which comprises:

(i) providing a composition as defined in the first aspect of the invention;

(ii) providing the composition to the engine;

(iii) providing heavy fuel oil to the engine; and (iv) combusting the fuel oil.

A sixth aspect of the invention is the use of detergent system (A) as defined in, the first aspect of the invention in combination with anhydride (B) as defined in the first aspect of the invention in a trunk piston marine lubricating oil composition for a medium-speed compression-ignited marine engine, to improve asphaltene handling during operation of the engine, fueled by a heavy fuel oil, in comparison with analogous operation where anhydride (B) has a ratio different from that defined in the first aspect of the invention.

In this specification, the following words and expressions, if and when used, have the meanings ascribed below:

"Succination ratio" in relation to component (B) means the number of groups derived from succinic anhydride for each substituted hydrocarbyl moiety. The "succinic ratio" or "succination ratio" refers to the ratio calculated in accordance with the procedure and mathematical equation set forth in columns 5 and 6 of U.S. Pat. No. 5,334,321. The calculation is asserted to represent the average number of succinic groups in an alkenyl or alkylsuccinic anhydride per substituted alkenyl or alkyl chain.

"active ingredients" or "(a.i.)" refers to additive material that is not diluent, solvent or unreacted hydrocarbyl moeity;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 or more mass % of a composition;

"minor amount" means less than 50 mass % of a composition;

"TBN" means total base number as measured by ASTM D2896.

Furthermore in this specification:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention in its various aspects, if and where applicable, will now be discussed in more detail below.

Oil of Lubricating Viscosity

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); alkylated naphthalenes; and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock are tabulated below

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention particularly embraces those of the above oils containing greater than or equal to 90% saturates and less than or equal to 0.03% sulphur as the oil of lubricating viscosity, eg Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

Preferably, the oil of lubricating viscosity in this invention contains 30, such as 50, mass % or more said basestocks. It may contain 60, such as 70, 80 or 90, mass % or more of said basestock or a mixture thereof. The oil of lubricating viscosity may be substantially all of said basestock or a mixture thereof.

It may be desirable, although not essential, to prepare one or more additive packages or concentrates comprising additives, whereby additives (A) and (B) can be added simultaneously to the oil of lubricating viscosity to form the TPEO.

The final formulations as a trunk piston engine oil may typically contain up to 30, preferably 10 to 28, more preferably 12 to 24, mass % of the additive package(s), the remainder being the oil of lubricating viscosity. The trunk piston engine oil may have a compositional TBN (using ASTM D2896) of 20 to 60, such as, 30 to 55. For example, it may be 40 to 55 or 35 to 50.

The combined treat rate of additives (A) and (B) contained in the lubricating oil composition may for example be in the range of 5 to 30, preferably 10 to 28, more preferably 12 to 24, mass %.

Overbased Metal Detergent Additive (A)

A metal detergent is an additive based on so-called metal "soaps", that is metal salts of acidic organic compounds, sometimes referred to as surfactants. They generally comprise a polar head with a long hydrophobic tail. Overbased metal detergents, which comprise neutralized metal detergents as the outer layer of a metal base (e.g. carbonate) micelle, may be provided by including large amounts of metal base by reacting an excess of a metal base, such as an oxide or hydroxide, with an acidic gas such as carbon dioxide.

In the present invention, overbased metal detergents (A) are overbased metal hydrocarbyl-substituted hydroxybenzoate, preferably hydrocarbyl-substituted salicylate, detergents.

"Hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl. The overbased metal hydrocarbyl-substituted hydroxybenzoate typically has the structure shown:

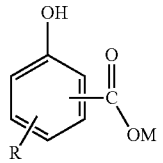

wherein R is a linear or branched aliphatic hydrocarbyl group, and more preferably an alkyl group, including straight- or branched-chain alkyl groups. There may be more than one R group attached to the benzene ring. M is an alkali metal (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group. When M is polyvalent, it is represented fractionally in the above formula.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term "low-based" is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations.

Small amounts of other cations may be present in the oil-insoluble metal salt, but typically at least 80, more typically at least 90, for example at least 95, mole % of the cations in the oil-insoluble metal salt are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may be expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). In this invention, Basicity Index is used. Basicity Index is the molar ratio of total base to total soap in the overbased detergent. The Basicity Index of the detergent (A) in the invention is preferably in the range of 1 to 8, more preferably 3 to 8, such as 3 to 7, such as 3 to 6. The Basicity Index may for example be greater than 3.

Overbased metal hydrocarbyl-substituted hydroxybenzoates can be prepared by any of the techniques employed in the art. A general method is as follows:

1. Neutralisation of hydrocarbyl-substituted hydroxybenzoic acid with a molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally-dispersed metal carbonate followed by a post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may be effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 $mm^2$/sec at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are used as a diluent (or oil) dispersion. If the reaction mixture contains insufficient oil to retain an oil solution after removal of the volatiles, further oil should be added. This may occur before, or at an intermediate point, or after solvent removal.

Preferably, the diluent used for (A) comprises a basestock containing greater than or equal to 90% saturates and less than or equal to 0.03% sulphur. (A) may contain up to 20, 30, 40, 50, 60, 70, 80 or 90, mass % or more (such as all) of said basestock. An example of said basestock is a Group II basestock.

Hydrocarbyl-Substituted Succinic Acid Anhydride (B)

The anhydride may constitute at least 1 to 7, such as 1.5 to 5, mass %, on an active ingredient basis, of the lubricating oil composition. Preferably it constitutes 2 to 5, more preferably 2.5 to 4, mass %.

The hydrocarbyl group is preferably a polyalkenyl group and preferably has from 36 to 216, more preferably 56 to 108, carbon atoms. It may have a number average molecular weight in the range of 500 to 3,000; preferably 700 to 2,300, even more preferably 800 to 1,500.

The succination ratio is, as stated, in the range of 1.4 to 4, preferably 1.4 to 3; more preferably it is in the range of 1.50 to 2.20, even more preferably 1.50 to 2.00, and most preferably 1.60 to 2.00.

Suitable hydrocarbons or polymers employed in the formation of the anhydrides of the present invention to generate the polyalkenyl moieties include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, such as with a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Possible polymers are unsaturated copolymers of ethylene and propylene and ethylene and butene-1. The interpolymers may contain a minor amount, e.g. 0.5 to 5 mole % of a $C_4$ to $C_{18}$ non-conjugated diolefin comonomer. However, it is preferred that the polymers comprise only alpha-olefin homopolymers, interpolymers of alpha-olefin comonomers and interpolymers of ethylene and alpha-olefin comonomers. The molar ethylene content of the polymers employed is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-$C(R^1)=C(R^1)=CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-$CH=CH_2$, and a portion of the polymers can contain internal monounsaturation, e.g. POLY-$CH=CH(R^1)$, wherein $R^1$ is as defined above. These terminally-unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymer constitutes those polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 30 to about 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. One embodiment utilizes polyisobutylene prepared from a pure isobutylene stream or a Raffinate I stream to prepare reactive isobutylene polymers with terminal vinylidene olefins. These polymers, referred to as highly reactive polyisobutylene (HR-PIB), may have a terminal vinylidene content of at least 65%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 400 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

To produce (B), the hydrocarbon or polymer backbone may be functionalized, with carboxylic anhydride-producing moieties selectively at sites of carbon-to-carbon unsaturation on the polymer or hydrocarbon chains, or randomly along chains using one or more of the three processes mentioned above or combinations thereof, in any sequence.

Processes for reacting polymeric hydrocarbons with unsaturated carboxylic, anhydrides and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, with carboxylic acid anhydride moieties by reacting the polymer or hydrocarbon under conditions that result in the addition of functional moieties or agents, i.e., acid, anhydride, onto the polymer or hydrocarbon chains primarily at sites of carbon-to-carbon unsaturation (also referred to as ethylenic or olefinic unsaturation) using the halogen- or radical-assisted functionalization (e.g. chlorination) processes, such as chloro or radical maleation.

Functionalization is preferably accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 130 to 220° C., e.g., 140 to 190° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 140° C. to 220° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

U.S. Pat. No. 4,234,435 (above-mentioned) describes PIBSA's made by the chloro-route (Diels-Alder process). Its abstract states "carboxylic acid acylating agents are derived from polyalkenes such as polybutenes, and a dibasic, carboxylic reactant such as maleic or fumaric acid or certain derivatives thereof. These acylating agents are characterized in that the polyalkenes from which they are derived have a Mn value of about 1300 to about 5000 and a Mw/Mn value of about 1.5 to about 4. The acylating agents are further characterized by the presence within their structure of at least 1.3 groups derived from the dibasic, carboxylic reactant for each equivalent weight of the groups derived from the polyalkene. The acylating agents can be reacted with a further reactant subject to being acylated such as polyethylene polyamines and polyols (e.g., pentaerythritol) to produce derivatives useful per se as lubricant additives or as intermediates to be subjected to post-treatment with various other chemical compounds and compositions, such as epoxides, to produce still other derivatives useful as lubricant additives."

CA 2,471,534 describes PIBSA's made by the ene-reaction (falling outside the present invention). Its abstract relates to "a process for forming an ene reaction product wherein an enophile, such as maleic anhydride, is reacted with reactive polyalkene having a terminal vinylidene content of at least 30 mol %, at high temperature in the presence of a free radical inhibitor. The polyalkenyl acylating agents are useful per se as additives in lubricating oils, functional fluids, and fuels and also serve as intermediates in the preparation of other products (e.g., succinimides) useful as additives in lubricating oils, functional fluids, and fuels. The presence of the free radical inhibitor during the high temperature reaction results in a reaction product that is low, or substantially free from sediment."

It is believed that the Diels-Adler process produces a dicyclic two bond attachment of the succinic group to the polybutene. This is structurally rather rigid and keeps the succinic group limited to an imide structure when reacted with a functionalising agent such as a polyamine. On the other hand an ene-reaction (1.5 hydrogen shift reaction) PIBSA has a single bond link between the succinic group and polybutene, and as such will allow rotation and opening of the succinic group (to dicarboxylic acid) to allow diamide formation in the right energy conditions (low temperature) and amine excess.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass %, polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 2% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or derivative) moieties randomly attached along the polymer chains: it being understood, of course, that some of the polymer chains remain ungrafted. The free radical grafting described above can be used for the other polymers and hydrocarbons of the present invention.

To provide the required functionality, the monounsaturated carboxylic reactant, preferably maleic anhydride, typically will be used in an amount ranging from about equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

Co-Additives

The lubricating oil composition of the invention may comprise further additives, different from and additional to (A) and (B). Such additional additives may, for example include ashless dispersants, other metal detergents, anti-wear agents such as zinc dihydrocarbyl dithiophosphates, anti-oxidants and demulsifiers.

The following examples illustrate but in no way limit the invention.

EXAMPLES

Components

The following compounds were used:

Oil of Lubricating Viscosity

An API Group II 600R basestock from Chevron (A) Detergents (1) a 225BN Ca alkyl salicylate (alkyl=C14-18)

(2) a 350BN Ca alkyl salicylate (alkyl=C14-18)

(B) A set of polyisobutene succinic anhydrides ("PIBSA") derived from a polyisobutene and made by a chloro-(Diels-Alder) process. The properties of each PIBSA are shown in the table in the RESULTS section below.

(C) A zinc dihydrocarbyl dithiophosphate at 0.5%.

Heavy Fuel Oil 1S0-F-RMG 380

Lubricants

Selections of the above components were blended with the oil of lubricating viscosity to give a range of trunk piston marine engine lubricants. Some of the lubricants were examples of the invention; others were reference examples for comparison purposes. Each lubricant contained the same combination of detergents in (A) to give a lubricating oil with a TBN of 40 mgKOH/g and a different PIBSA at a treat rate of 2-6 mass %.

Testing

Light Scattering

Test lubricants were evaluated for asphaltene dispersancy using light scattering according to the Focused Beam Reflectance Method ("FBRM"), which predicts asphaltene agglomeration and hence 'black sludge' formation.

The FBRM test method was disclosed at the $7^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on base stocks containing greater than or less than 90% saturates, and greater than or less than 0.03% sulphur. The predictions of relative performance obtained from FBRM were confirmed by engine tests in marine diesel engines.

The FBRM probe contains fibre optic cables through which laser light travels to reach the probe tip. At the tip, an optic focuses the laser light to a small spot. The optic is rotated so that the focussed beam scans a circular path between the window of the probe and the sample. As particles flow past the window, they intersect the scanning path, giving backscattered light from the individual particles.

The scanning laser beam travels much faster than the particles; this means that the particles are effectively stationary. As the focussed beam reaches one edge of the particle the amount of backscattered light increases; the amount will decrease when the focused beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time, the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The test lubricant formulations were heated to 60° C. and stirred at 400 rpm. An aliquot of heavy fuel oil (16% w/w) was introduced into the lubricant formulation under stirring using a four-blade stirrer (at 400 rpm) and at 60° C. This mixture was stirred overnight. With the temperature at 60° C. the FBRM probe was inserted into the sample—A value for the average counts per second was taken when the count rate had reached an equilibrium value (typically after 30 minutes equilibration time).

Results

Response curves were generated showing the number of particle counts against active ingredient treat rate of the PIBSA. Results are presented as active ingredient treat rate required to deliver particle counts equivalent to a reference oil. Thus, lower active ingredient treat rate values indicate a better performance.

In the table below, the properties shown (Succination Ratio and $M_n$) are of the PIBSA used in each of the test lubricants.

TABLE 1

| Examples | Maleation process | Succination Ratio | PIB $M_n$/ g mol$^{-1}$ | Active ingredient Treat rate required to reach normalised count = 1/wt % |
|---|---|---|---|---|
| Comparative example 1 | Chloro | 1.17 | 1331 | 4.50 |
| Comparative Example 2 | Chloro | 1.19 | 950 | 4.93 |
| Comparative Example 3 | Chloro | 1.27 | 2225 | 4.10 |
| Comparative Example 4 | Chloro | 1.31 | 1600 | 4.70 |
| Example 1 | Chloro | 1.41 | 1331 | 2.58 |
| Example 2 | Chloro | 1.62 | 1331 | 3.10 |
| Example 3 | Chloro | 1.64 | 950 | 1.60 |
| Example 4 | Chloro | 1.88 | 950 | 1.70 |
| Example 5 | Chloro | 1.91 | 1331 | 1.83 |
| Example 6 | Chloro | 2.06 | 950 | 2.09 |
| Example 7 | Chloro | 2.17 | 2225 | 2.67 |
| Example 8 | Chloro | 2.20 | 2225 | 2.44 |
| Example 9 | Chloro | 2.67 | 950 | 2.41 |
| Example 10 | Chloro | 3.10 | 1331 | 2.01 |
| Example 11 | Chloro | 3.94 | 950 | 2.35 |

The table shows that much better results are achieved at higher succination ratios i.e. 1.41 to 3.94, as indicated below the bar. Although good results are achievable at higher PIB molecular weights, PIBSA's made therefrom have very high viscosities. They therefore have to be diluted much more than PIBSA's of lower PIB molecular weight. PIBSA's of PIB $M_n$ 1,331 and 950 g mol$^{-1}$ are therefore preferred. Very high succination ratios or high polymer molecular weights leads to high viscosities; therefore a PIB $M_n$ range of 700-1500 g mol$^{-1}$ and an SR range 1.50-2.00, preferably 1.70 or 1.65-2.00, are preferred.

The anhydride additives of the invention have been shown to boost the performance of salicylates to improve their asphaltene dispersancy. Conventionally, PIBSAPAM-type dispersants are used to disperse contaminants in lubricating oils. Therefore, a comparison was made with two such PIBSAPAM-type dispersants (see table below). In combination with salicylates it can be seen that PIBSAPAM-type dispersants are not able to reach equivalent performance to the anhydride additives, which reach a normalised counts of '1' (i.e. equivalent performance) at much lower active ingredient treat rates.

| Example | Description | Active ingredient Treat rate/wt % | Normalised counts |
|---|---|---|---|
| Comparative Example 5 | Low molecular weight, low SR, chloro PIBSAPAM type dispersant[1] | 3 | 9.0 |
| Comparative Example 6 | High molecular weight chloro, low SR, PIBSAPAM type dispersant[1] | 3.3 | 4.17 |

[1]As described in U.S. Pat. No. 3,219,666 (low molecular weight PIBSAPAM) and U.S. Pat. No. 6,127,321 (high molecular weight PIBSAPAM).

The materials of the invention do not work in the absence of salicylate detergents to affect asphaltene dispersancy. In the table below, the two PIBSAs were tested in the absence of salicylates and were unable to reach equivalent performance to any of the PIBSA/salicylate combinations of the invention. Even at significantly increased treat rates, no further improvements were observed.

| Example | Material | SR | Active ingredient Treat/wt % | Normalised counts |
|---|---|---|---|---|
| Comparative Example 7 | PIBSA from Example 4 | 1.18 | 3.58 | 6.4 |
| Comparative Example 8 | Example 2 | 1.62 | 3.78 | 7.16 |

Furthermore, PIBSAs synthesised by a 'thermal-ene' approach were ineffective compared with the PIBSAs of the invention derived from a chloro or radical maleation approach. These were tested in combination with salicylates.

| Example | Process | SR | PIB $M_n$/ g mol$^{-1}$ | Active ingredient Treat rate required to reach normalised count = 1/wt % |
|---|---|---|---|---|
| Comparative Example 9 | Thermal | 1.18 | 450 | 4.72 |
| Comparative Example 10 | Thermal | 1.05 | 700 | 4.84 |

-continued

| Example | Process | SR | PIB $M_n$/g $mol^{-1}$ | Active ingredient Treat rate required to reach normalised count = 1/wt % |
|---|---|---|---|---|
| Comparative Example 11 | Thermal | 1.05 | 950 | 4.8 |
| Comparative Example 12 | Thermal | 1.6 | 1300 | 6.8 |

What is claimed is:

1. A trunk piston marine engine lubricating oil composition for improving asphaltene handling in use thereof, in operation of such engine when fuelled by a heavy fuel oil, which composition comprises, or is made by admixing, an oil of lubricating viscosity and, in respective minor amounts:

(A) an overbased metal hydrocarbyl-substituted hydroxybenzoate detergent system, and (B) a hydrocarbyl-substituted succinic acid anhydride, where the ratio of succinic anhydride groups per substituted hydrocarbyl moiety is in the range of 1.4 to 4.

2. The composition of claim 1, wherein said hydrocarbyl-substituted succinic acid (B), is made by halogen- or radical-assisted functionalization processes.

3. The composition of claim 1 wherein, in said hydrocarbyl-substituted succinic acid (B), the hydrocarbyl group has a number average molecular weight in the range of 500 to 3,000.

4. The composition of claim 3, wherein said number average molecular weight is in the range of 700 to 2,300.

5. The composition of claim 4, wherein said number average molecular weight is in the range of 800 to 1,500.

6. The composition of claim 1, wherein, in said hydrocarbyl-substituted succinic acid anhydride (B), the ratio of succinic anhydride groups per substituted hydrocarbyl moiety is in the range of 1.4 to 3.

7. The composition of claim 6, wherein, in said hydrocarbyl-substituted succinic acid anhydride (B), the ratio succinic anhydride groups per substituted hydrocarbyl moiety is in the range of 1.50 to 2.20.

8. The composition of claim 7, wherein, in said hydrocarbyl-substituted succinic acid anhydride (B), the ratio succinic anhydride groups per substituted hydrocarbyl moiety is in the range of 1.50 to 2.00.

9. The composition of claim 8, wherein, in said hydrocarbyl-substituted succinic acid anhydride (B), the ratio succinic anhydride groups per substituted hydrocarbyl moiety is in the range of 1.60 to 2.00.

10. The composition of claim 1, wherein, in said hydrocarbyl-substituted succinic acid anhydride (B), said hydrocarbyl group is a polyalkenyl group.

11. The composition of claim 10, wherein, in said hydrocarbyl-substituted succinic acid anhydride (B), said hydrocarbyl group is a polyisobutylene group.

12. The composition of claim 1, wherein said hydrocarbyl-substituted succinic acid anhydride (B) is made by a chloro-maleation process.

13. The composition of claim 1, wherein said oil of lubricating viscosity comprises a Group II, III, IV or V basestock.

14. The composition of claim 1, wherein said oil of lubricating viscosity contains 30 mass % or more of a basestock containing greater than or equal to 90% saturates and less than or equal to 0.03% sulphur, or a mixture thereof.

15. The composition of claim 14, wherein said oil of lubricating viscosity contains 50 mass % or more of a basestock containing greater than or equal to 90% saturates and less than or equal to 0.03% sulphur, or a mixture thereof.

16. The composition of claim 1, having a TBN in the range of 20 to 60 mg KOH/g.

17. The composition of claim 16, having a TBN in the range of 30 to 55 mg KOH/g.

18. The composition of claim 1, wherein detergent system (A) comprises a calcium alkyl salicylate detergent system.

19. A method of operating a trunk piston medium-speed compression-ignited marine engine comprising:

(i) fuelling the engine with a heavy fuel oil; and (ii) lubricating the engine with a composition as defined in claim 1.

20. A method of dispersing asphaltenes in trunk piston marine lubricating oil composition during its lubrication of surfaces of a medium-speed compression-ignited marine engine and operation of the engine, which comprises:

(i) providing a composition as defined in of claim 1;

(ii) providing the composition to the engine;

(iii) providing heavy fuel oil to the engine; and (iv) combusting the fuel oil.

21. A concentrate suitable for blending into a composition of claim 1, said concentrate comprising detergent system (A) and hydrocarbyl-substituted succinic acid anhydride (B), as defined in claim 1.

* * * * *